United States Patent [19]

Naab

[11] 4,239,437

[45] Dec. 16, 1980

[54] HEAVY DUTY RECEPTACLE UNLOADING DEVICE FOR TRUCKS

[75] Inventor: Jakob Naab, Mainz, Fed. Rep. of Germany

[73] Assignee: Zoller-Kipper GmbH, Mainz-Laubenheim, Fed. Rep. of Germany

[21] Appl. No.: 927,526

[22] Filed: Oct. 20, 1978

[51] Int. Cl.[3] ..... B65F 3/04

[52] U.S. Cl. ..... 414/408; 414/411; 414/917

[58] Field of Search ..... 414/404, 406, 408, 411, 414/414, 420, 422, 546, 547, 533, 534, 555, 556, 557, 558, 917

[56] References Cited

U.S. PATENT DOCUMENTS

| | | | |
|---|---|---|---|
| 2,696,923 | 12/1954 | Messick | 414/557 |
| 2,917,192 | 12/1959 | Ricker et al. | 414/420 |
| 3,658,199 | 4/1972 | Owen | 414/406 |

*Primary Examiner*—Robert G. Sheridan

*Attorney, Agent, or Firm*—H. Gibner Lehmann; K. Gibner Lehmann

[57] ABSTRACT

A heavy-duty lifting and tilting device having features which make it especially advantageous for incorporation in garbage trucks and the like. The highly-stressed components of the device are short and compact, being particularly arranged to produce a sturdy mechanism that is well adapted to withstand rough handling and abuse when in use. Additionally, the device provides the greatest possible ground clearance, which is of great importance when the truck is traversing uneven terrain, in a heavily-loaded condition.

18 Claims, 4 Drawing Figures

HEAVY DUTY RECEPTACLE UNLOADING DEVICE FOR TRUCKS

BACKGROUND

This invention relates to lifting and tilting devices for emptying large and heavy receptacles into collection containers, and more particularly to the handling of garbage cans whose contents are to be dumped into garbage trucks. Devices of this type have generally comprised a lifting mechanism adapted to grip the garbage cans, said mechanism including a pair of pivoting arms which are mounted so as to swing about a horizontal axis for cooperation with a pour-in device. The pivoting arms are connected to cylinder and piston assemblies to be actuated thereby.

In the known devices of this type, the cylinder and piston assemblies which are provided to power the pivoting arms are supported by the pour-in device at a point below the mounting for the arms. This arrangement has the disadvantage that a considerable part of the pour-in device is included in the power transmission path between the support point for the cylinder and piston assembly and the mounting point of the pivoting arms and therefore must be of appropriately rugged and heavy design. Another significant disadvantage of this known arrangement is that such a low location of the supporting point for the cylinder and piston assembly causes the garbage trucks to lose a considerable amount of clearance. Since the pour-in device in garbage trucks becomes lowered with the increase in loads and the corresponding greater spring stresses, and since garbage trucks are required to negotiate rough terrain, for instance when depositing their loads in the dump area, the greatest possible ground clearance is needed, particularly when the vehicle is loaded.

SUMMARY

Accordingly, one object of the invention is to provide an improved lifting and tilting device for emptying heavy receptacles into collecting containers, particularly for emptying garbage cans into garbage collection vehicles, wherein on the one hand, the power transmission path between the cylinder and piston assembly support point and the pivot mount for the lifting arms is especially short and, on the other hand, there is had the greatest possible vehicle ground clearance, even in the loaded condition.

According to the invention, this object is achieved by locating the cylinder piston assembly so that, when in its starting position, it is disposed roughly parallel to the pivoting arms and engages lugs which are provided in the lower end areas of the pivoting arms and which extend beyond the plane that contains the pivoting axis of the arms and is parallel to the latter. The cylinder and piston assembly is supported by mounting plates that are fastened to the pour-in device, to which plates the pivoting arms are also mounted to be pivotable about the horizontal axis. In addition to solving the problem posed above, there is also had a particularly compact lifting and tilting device in accordance with the invention, which thus guarantees an optimum ground clearance in conjunction with the favorable development of the pivoting forces generated by the cylinder and piston assembly. The mounting plates represent a central mechanism which absorbs the support forces of the cylinder and piston assembly and which, with the mountings of the pivoting arms, completes the power transmission path. This central mechanism can be designed massively and strong, without having to make the weight of the entire device overly great.

In the known lifting and tilting devices where the lift is hinged to the pivoting arms and the motion of the lift is derived from the tilting motion of the arms, it is naturally necessary to space the support point of the lift away from the mounting point of the pivoting arms. Heretofore the support point of the lift was provided on a wall of the pour-in device. This necessitated a particularly strong and massive design of parts of the pour-in device. In contrast thereto, the mechanism deriving the lifting motion from the tilting motion of the pivoting arms can advantageously be supported by the mounting plates which characterize the invention. This further supplements and completes the function of the mounting plates as a central, force absorbing and transmitting mechanism. In addition, by combining all the mounting and supporting points in the mounting plates, the operating safety of the device is greatly increased, and the danger of accidents greatly reduced.

The mechanism deriving the lifting motion from the tilting motion, in one embodiment of the invention, can be guide rods pivotly connected respectively at one end each to a mounting plate and at their other ends to the container carrying arms which form the lift, and can be designed in the form of angular levers connected to the pivoting arms. In the lower starting positions of the pivoting arms, the angular levers connected to the guide rods can be oriented vertically upwards while the hinge points of the guide rods at the mounting plates is harmonized with or adapted to the length of the angular levers so that the initial, upwardly directed tilting motion of the pivoting arms is transformed into an approximately equal, downward counter-tilting motion of the container carrying arms. This transforms, in a particularly simple manner, a conversion of the initial tilting motion of the pivoting arms into a lifting motion of the carrying arms.

It is particularly advantageous, within the scope of the invention, if the cylinder and piston assembly is constructed with simple pistons guided in their cylinders, and the cylinders are hinged to the mounting plates at a distance away from the ends of the cylinders. The cylinder and piston assembly constructed with simple cylinders and pistons has the advantage over telescope cylinder arrangements, of being much cheaper and simpler. However, the same stroke length of a cylinder and piston assembly of simple design requires a considerably greater cylinder length. By supporting the cylinder and piston unit on the mounting plates provided by the invention and thus in the vicinity of the pivotal axis of the pivoting arms it is possible without any problem to accommodate the greater cylinder lengths required, since the mounting elements that are needed for the hinged support of the cylinders are moved away from the cylinder ends and into the central area of the cylinder length.

To strengthen and improve the mounting and supporting points considerably, additional mounting plates parallel to the first-mentioned ones can be coordinated with the latter, within the scope of the invention, the pivoting arms and the cylinder and piston units being accommodated between and mounted in both sets of plates. This not only improves the mounting and support of the pivoting arms and cylinder and piston units significantly, but it also creates a more or less symmetrical power transmission path arrangement between the support points of the cylinder and piston units and the pivoting-arm mounting points.

In lifting and tilting devices according to the invention, as equipped with a mechanism for the derivation of the lifting motion from the tilting motion of the pivoting arms it is possible within the scope of the invention to coordinate with the above mentioned mounting plates, parallel thereto and spaced on both sides, still other mounting plates so that the pivoting arms and cylinder and piston assemblies can be mounted between adjoining plates while the guide rods of the mechanisms which translated the tilting motion into the lifting motion can be mounted between other adjoining mounting plates.

Moreover, the guide rods can also be provided with forkshaped ends straddling both sides of the mounting plates, which may be extended if required. This latter arrangement makes it possible to obviate additional mounting plates for the guide rods.

It is advantageous, in the lifting and tilting devices having a pair of pivoting-arms made according to the invention, to provide the additional mounting plates for the pivoting arms and cylinder-piston units on the respective outer-sides of the device, and the additional mounting plates for the guide rods on the respective side interiors. In lifting-tilting devices having a pair of pivoting arms according to the invention, which receive between them the containers to be emptied, there can be provided a funnel-shaped sheet metal baffle and guide, disposed between the two pivoting arms and which enters the pour-in opening during the tilting-in motion. This sheet metal baffle and guide represents a safety for the mounting and support of the pivoting arms and of the cylinder-piston units on the mounting plates. In particular, the funnel-shaped sheet metal baffle and guide prevents dirt or garbage from reaching the mounting plates during the emptying operation. When the lifting-tilting device is constructed with guide rods as the mechanism deriving the lifting motion from the tilting motion, and with carrying arms hinged to the pivoting arms and constructed in the form of angular levers as the lift, it can be advantageous to mount the sheet metal baffle and guide on the carrying arms, and preferably on the angular lever arms which are oriented upwardly in the starting position of the pivoting arms.

Several embodiments examples of the invention are described below in greater detail, with reference to the drawing in which.

Figure 1:
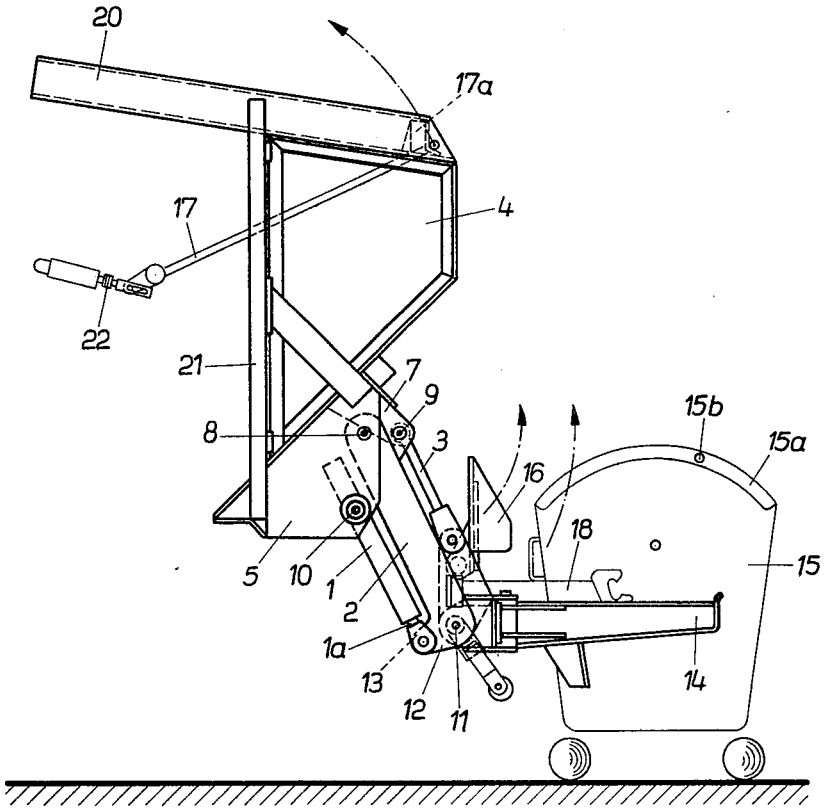
FIG. 1 shows a lifting-tilting device, according to the invention, in side elevation occupying the lower-most position.

As is evident from the drawings, in particular from FIG. 1 in accordance with the invention, the cylinder-piston unit 1 for pivoting the pair of pivoting arms 2 and pair of guide rods 3 is disposed roughly parallel to the respective pivoting arms 2, for the starting position of the device. The mounting plates 5, 6, and 7 provided by the invention (see FIG. 3), are fastened directly to the pour-in device 4 and arranged parallel to each other, serving as upper hinge points for the cylinder-piston unit 1, the pivoting arms 2 and also for the guide rods 3, the function of which will be explained below.

Figure 3:
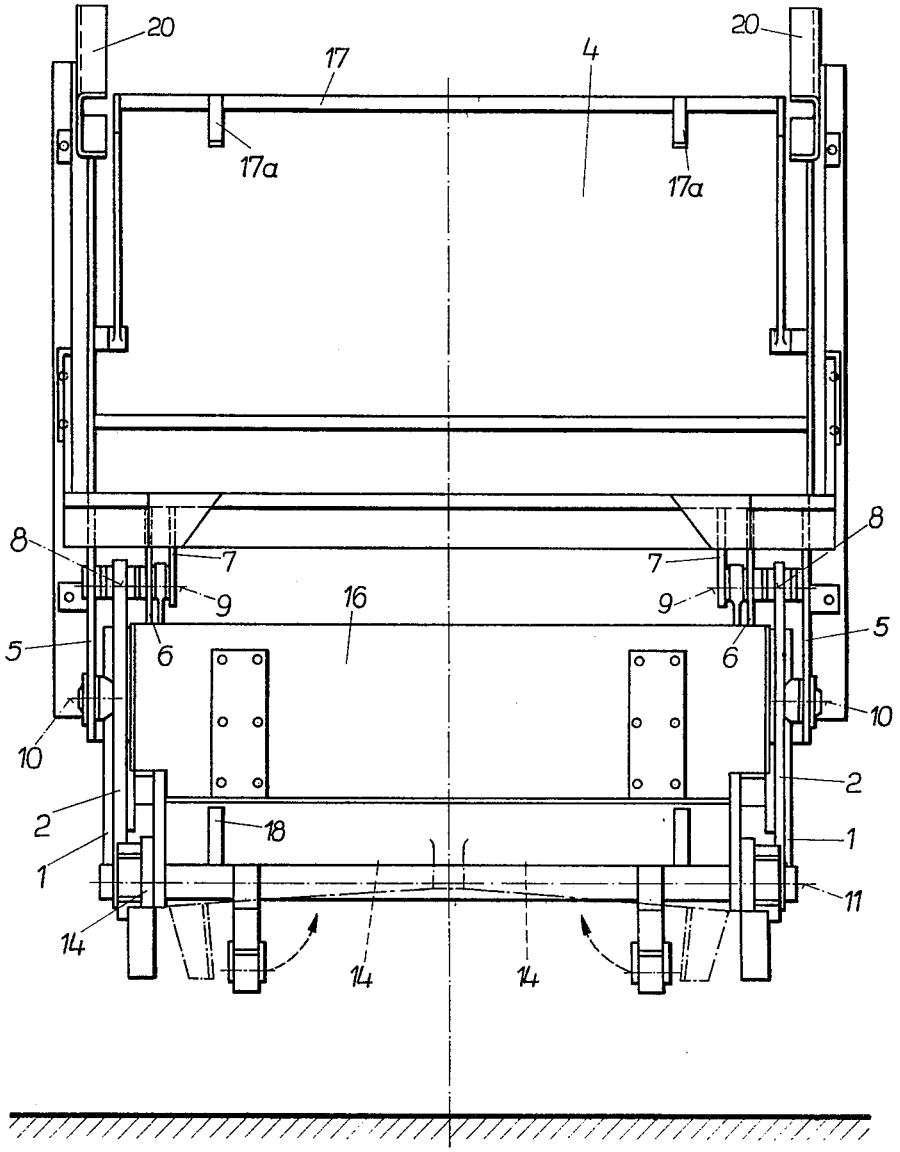
FIG. 3 shows the device according to FIG. 1 in a front elevational view and without the garbage can.

As may be seen from the front view of FIG. 3, the mounting plates 5, 6, 7 (which perform the function of a central, force-absorbing and transmitting mechanism) are disposed on both sides of the pour-in opening 4. The mounting plates 5 and 6 accommodate the shaft 8 of the respective pivoting arms 2 while the shaft 9 of the guide rods 3 is mounted in the plates 6 and 7. The upper hinge point 10 of the cylinder-piston unit 1 is disposed below this and between the mounting plates 5 and 6 in the manner of a transverse bearing pin.

Formed in the lower region of each pivoting arm 2 is a lug 12 which extends beyond the lower pivot axis 11 and serves to mount the piston rod 1*a* of the cylinder-piston unit 1. As is evident from FIG. 1, the transverse mounting pin 10 is disposed so as to be spaced from the upper end of the cylinder-piston unit 1. These measures make possible a structural length of the cylinder-piston unit 1 which is greater than the distance between the hinge point 10 and the lugs 12.

The upper ends of the guide rods 3 that derive the lifting motion from the tilting motion are hinged (as already described) between the mounting plates 5 and 7 while their lower ends are linked to the upwardly oriented parts of the angular lever arms 13, there being coaxially mounted to this hinge point at the same time the respective carrying arms 14 and the respective pivoting arms 2. The horizontal parts of the angular lever arms 13 go over into the adjoining carrying arms 14.

The motion or work cycle of the tilting device is as follows: Upon the actuation of the cylinder-piston unit 1, the pair of pivoting arms 2 moves upwardly, but the carrying arms 14 remain in an essentially horizontal position for the time being. The garbage can 15 is grabbed and lifted up vertically without performing a tilting motion, however, which means that the initial, upwardly-oriented tilting motion of the pivoting arms is translated by the guide rods into an approximately equal downward counter-tilting motion of the carrying arms. Up to this point in time, the cylinder-piston units 1, the pivoting arms 2, and the guide rods 3 are essentially still in a mutually parallel position. Only after the essentially horizontal line of the pivoting arms 2 is exceeded does the motion of the carrying arms 4, derived from the tilting motion of the pair of pivoting arms 2, become a tilting motion so that the guide rods 3 push the downwardly-oriented parts of the angular lever arms 13 downwardly, and in the course of the continuing upward pivoting motion, the carrying arms 14 are pivoted by the guide rods 3 in the sense of a tilt-in motion relative to the pivoting arms 2; the container 15 is swung towards the pour-in opening 4, as may be seen from FIG. 2. During the lifting motion, the container 15 is in contact with the funnel-shaped sheet metal baffle and guide 16 disposed between the two pivoting arms 2 and fastened to the carrying arms 14. This sheet metal baffle and guide 16 represents a safety for the mounting and support of the pivoting arms 2 and of the cylinder-piston units 1 on the mounting plates, in that it prevents dirt or garbage from being able to reach the mounting plates when emptying the container.

Figure 4:
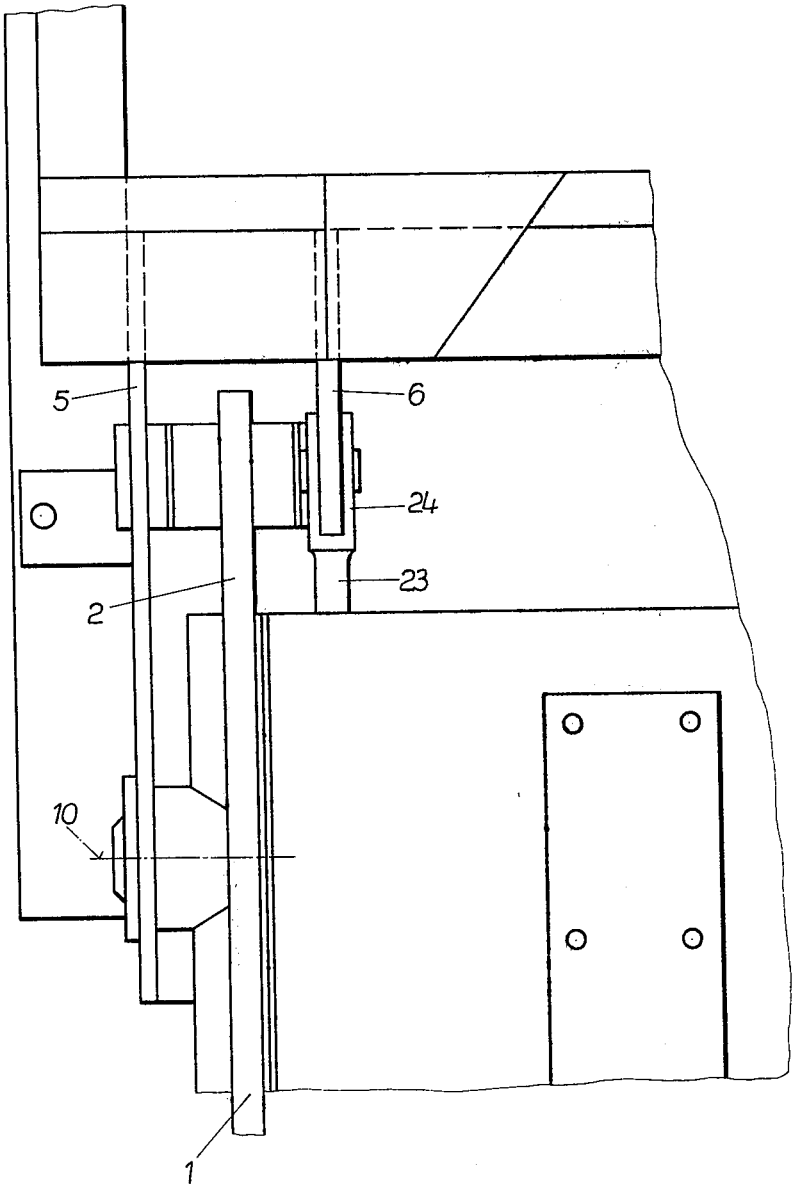
FIG. 4 is an enlarged detail view of a mounting plate arrangement, in another embodiment of the invention.

FIG. 4 shows an embodiment of mounting plate arrangement, in which only two mounting plates 5 and 6 are provided for each side to support the cylinder-piston units, and the pivoting arms and guide rods. Whereas the cylinder-piston units 1 and the pivoting arms 2 are mounted to the bearing plates 5 and 6 in the manner already described, the guide rods 23 are fastened or mounted directly to the mounting plates 6 by means of forked parts 24 disposed at the upper ends of the guide rods 23 and straddling both sides of the mounting plates 6.

Figure 2:
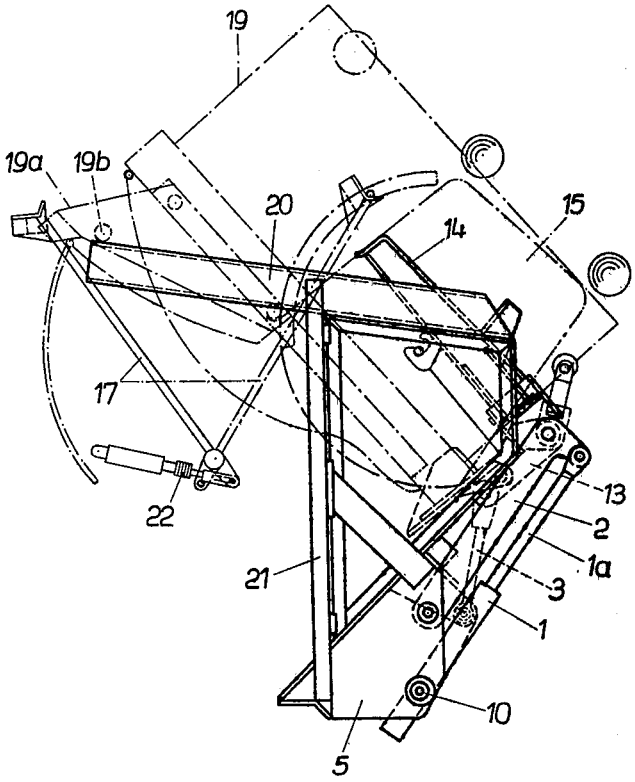
FIG. 2 shows the device according to FIG. 1 but in the upper-most or tilt-in position.

As FIGS. 1 and 2 show, particularly FIG. 2, it is possible to pick up and empty containers of different sizes with the lifting-tilting device according to the invention. The cover 15*a* of the container 15 is opened by the cover opening device 17 whose forkshaped end pieces 17*a* grab the cover 15*a* by its stubs 15*b* and push it back during the tilting swing-in motion. On the other hand, the stubs 19*b* on the cover 19*a* of the container 19 run in the course of the tilting swing-in motion, on the guide rails 20 which are disposed on both sides of the pour-in opening 4 and are of U-profile, the cover 19*a* being opened by the guide rails 20 which are descending towards the rear. The stubs 19*b* can be rotatably mounted to reduce friction.

The carrying arms 14, 18 adapted for the various containers 15, 19, are mounted so they can pivot vertically and can be folded-in, while the vehicle is in motion, as indicated by the broken lines in FIG. 3. This figure, however, does not show the carrying arms 18 as folded in, for the sake of greater clarity, but only folded out.

The mounting plate arrangement according to the invention, in conjunction with the various hinge points of the respective units and devices creates a particularly compact lifting-tilting device which assures optimum ground clearance and a favorable development of the pivoting forces generated by the cylinder-piston units. The mounting plates represent a central mechanism which absorbs the support forces of the cylinder-piston units and completes the power transmission path for the mounting, while the overall weight of the devices is not increased significantly despite the massive design of the plates.

Variations and modifications are possible without departing from the spirit of the invention.

I claim:

1. A lifting-tilting apparatus for emptying large and heavy receptacles into collecting containers, particularly garbage receptacles into garbage collecting vehicles, comprising in combination:

(a) a lifting device 13, 14 for gripping said receptacles, (b) pivoting arms 2 having means for mounting said lifting device 13, 14 for raising and swinging-in movement along a predetermined lifting path and a swinging-in path respectively, (c) said pivoting arms 2 having lugs 12 by which they are actuated, (d) a pour-in device 4, (e) elongate cylinder-piston assemblies 1 engageable with the lugs 12 of the pivoting arms 2 to drive the same, (f) said assemblies 1 extending roughly parallel to said pivoting arms 2, (g) mounting plates 5 secured to the pour-in device 4, (h) means 8 pivotally attaching said pivoting arms to said mounting plates for movement about a horizontal axis 8, (i) said lugs 12 extending below the plane of said horizontal pivotal axis 8, (j) means 10 supporting the cylinder-piston assemblies on said mounting plates, and (k) mechanism 3 carried by said mounting plates 5, positively driving said lifting device 13, 14 both in said lifting path and in said swinging-in path in response to the tilting motion of the pivoting arms 2, as directly effected by said piston-cylinder assemblies 1.

2. The invention as defined in claim 1 wherein:

(a) said mechanism carried by the mounting plates comprises guide rods having ends hingedly secured to the mounting plates, (b) said lifting device comprising carrying arms in the form of angular levers, pivotally secured to said pivoting arms, (c) the other ends of said guide rods being mounted to said angular levers.

3. The invention as defined in claim 2, and further including:

(a) additional pairs of mounting plates respectively straddling said first-mentioned plates, (b) said cylinder-piston assemblies being accommodated between adjoining pairs of said mounting plates, (c) said guide rods being accommodated between other adjoining pairs of said mounting plates.

4. The invention as defined in claim 3, wherein:

(a) the first-mentioned adjoining pairs of mounting plates are at the respective outer sides of the lifting-tilting device, and the second-mentioned adjoining pairs of mounting plates are on the respective side interiors of the lifting-tilting device.

5. The invention as defined in claim 2, and further including:

(a) a funnel-shaped sheet-metal baffle and guide adapted to enter the opening of the pour-in device during the tilting-in motion of the pivoting arms.

6. The invention as defined in claim 2, wherein:

(a) the guide rods have fork-shaped extremities straddling both sides of the mounting plates.

7. The invention as defined in claim 1, wherein:

(a) the cylinder-piston assemblies comprise simple pistons guided in cylinders, (b) said cylinders intermediate their ends being hinged to the mounting plates.

8. The invention as defined in claim 1, and further including:

(a) additional mounting plates secured to the pour-in device and disposed parallel to said first-mentioned mounting plates, (b) said pivoting arms and cylinder-piston assemblies being accommodated between adjoining pairs of mounting plates.

9. The invention as defined in claim 1, wherein:

(a) said lifting device comprises angular levers having long arms engageable with the receptacle and short arms pivotally connected to said mechanism, said short arms extending upward from the long arms when the latter are essentially horizontal.

10. A lifting-tilting apparatus for emptying large and heavy receptacles into collecting containers, particularly garbage receptacles into garbage collecting vehicles, comprising in combination:

(a) a lifting device for gripping said receptacles, (b) pivoting arms mounting said lifting device for raising and swinging-in movement, (c) said pivoting arms having lugs by which they are actuated, (d) a pour-in device, (e) elongate cylinder-piston assemblies engageable with the lugs of the pivoting arms to drive the same,
(f) said assemblies extending roughly parallel to said pivoting arms,
(g) mounting plates secured to the pour-in device,
(h) means pivotally attaching said pivoting arms to said mounting plates for movement about a horizontal axis,
(i) said lugs extending below the plane of said horizontal pivotal axis and being generally parallel to the planes of said pivoting arms,
(j) means supporting the cylinder-piston assemblies on said mounting plates,
(k) means for movably mounting the lifting device on the pivoting arms,
(l) mechanism carried by said mounting plates, actuating said lifting device in a predetermined path in response to the tilting motion of the pivoting arms.
(m) said mechanism carried by the mounting plates comprising guide rods having ends hingedly secured to the mounting plates,
(n) said lifting device comprising carrying arms in the form of angular levers, pivotally secured to said pivoting arms,
(o) the other ends of said guide rods being mounting to said angular levers,
(p) a funnel-shaped sheet-metal baffle and guide adapted to enter the opening of the pour-in device during the tilting-in motion of the pivoting arms, and
(q) means mounting said baffle and guide on said carrying arms.

11. A lifting-tilting apparatus for emptying large and heavy receptacles into collecting containers, particularly garbage receptacles into garbage collecting vehicles, comprising in combination:
(a) a lifting device for gripping said receptacles,
(b) pivoting arms mounting said lifting device for raising and swinging-in movement,
(c) said pivoting arms having lugs by which they are actuated,
(d) a pour-in device,
(c) elongate cylinder-piston assemblies engageable with the lugs of the pivoting arms to drive the same,
(f) said assemblies extending roughly parallel to said pivoting arms,
(g) mounting plates secured to the pour-in device,
(h) means pivotally attaching said pivoting arms to said mounting plates for movement about a horizontal axis,
(i) said lugs extending below the plane of said horizontal pivotal axis and being generally parallel to the planes of said pivoting arms,
(j) means for supporting the cylinder-piston assemblies on said mounting plates, and
(k) a lid-opening device mounted above the opening of the pour-in device,
(l) said lid-opening device having guide rails which extend obliquely upward and are adapted to be engaged by run pins on the cover of a receptacle.

12. The invention as defined in claim 11, and further including:
(a) supporting beams for connecting the guide rails to the mounting plates.

13. The invention as defined in claim 12, and further including:
(a) receptable-carrying means adapted to accommodate receptacles of different sizes, and
(b) said lid-opening device comprising a combination adapting it to receptacles of different sizes.

14. The invention as defined in claim 13, wherein:
(a) said lid-opening device comprises a catch and counterbearing frame acting against an elastic element, cooperable with smaller receptacles,
(b) said guide rails being cooperable with larger receptacles.

15. A lifting-tilting apparatus for emptying large and heavy receptacles into collecting containers, particularly garbage receptacles into garbage collecting vehicles, comprising in combination:
(a) a lifting device for gripping said receptacles,
(b) pivoting arms mounting said lifting device for raising and swinging-in movement,
(c) said pivoting arms having lugs by which they are actuated,
(d) a pour-in device,
(e) elongate cylinder-piston assemblies engageable with the lugs of the pivoting arms to drive the same,
(f) said assemblies extending roughly parallel to said pivoting arms,
(g) mounting plates secured to the pour-in device,
(h) means pivotally attaching said pivoting arms to said mounting plates for movement about a horizontal axis,
(i) said lugs extending below the plane of said horizontal pivotal axis and being generally parallel to the planes of said pivoting arms,
(j) means supporting the cylinder-piston assemblies on said mounting plates,
(k) means for movably mounting the lifting device on the pivoting arms,
(l) mechanism carried by said mounting plates, actuating said lifting device in a predetermined path in response to the tilting motion of the pivoting arms,
(m) said mechanism carried by the mounting plates comprising guide rods having ends hingedly secured to the mounting plates.
(n) said lifting device comprising carrying arms in the form of angular levers, pivotally secured to said pivoting arms,
(o) the other ends of said guide rods being mounted to said angular levers,
(p) said angular levers being oriented roughly vertically upward when the pivoting arms are in their lowered, starting positions,
(q) the hinge points between the guide rods and mounting plates being so related with respect to the lengths of the upwardly-oriented angular levers that the initial upward tilting movement of the pivoting arms is transformed into an approximately equal downward, counter-tilting motion of the carrying arms.

16. A lifting-tilting apparatus for emptying large and heavy receptacles into collecting containers, particularly garbage receptacles into garbage-collecting vehicles, comprising in combination:
(a) a pour-in device provided at said collecting container and having a receiving opening,
(b) pivoting arms each at one end pivotally mounted to the said pour-in device at the said collecting container for upwardly and downwardly swinging movement about a horizontal axis which is located adjacent to the said pour-in device, (c) a lifting device for gripping said containers, said lifting device being pivotally mounted on the other ends of said pivoting arms for swinging movement relative to the said pivoting arms about a horizontal axis, (d) elongate cylinder-piston assemblies mounted on said pour-in device for swinging movement about a horizontal axis, said assemblies being connected to said pivoting arms to drive the same, and, (e) means pivotally attached to both said pour-in device and said lifting device, providing for a turning movement of the said lifting device relative to the said pivoting arms inwardly with respect to the said pour-in device when the said pivoting arms are swung upwardly, and providing for an opposite turning movement of said lifting device outwardly with respect to said pour-in device when the said pivoting arms are swung downwardly, (f) a lid-opening device mounted at the receiving opening of the said pour-in device, (g) said lid-opening device having guide rails which extend obliquely upward and are adapted to be engaged by run pins on the cover of a receptacle.

17. A lifting-tilting apparatus for emptying large and heavy receptacles into collecting containers, particularly garbage receptacles into garbage-collecting vehicles, comprising in combination:

(a) a pour-in device provided at said collecting container and having a receiving opening, (b) pivoting arms each at one end pivotally mounted to the said pour-in device at the said collecting container for upwardly and downwardly swinging movement about a horizontal axis which is located adjacent to the receiving opening of the said pour-in device, (c) a lifting device for gripping said containers, said lifting device being pivotally mounting on the other ends of the said pivoting arms for swinging movement relative to the said pivoting arms about a first horizontal axis, (d) elongate cylinder-piston assemblies mounted on said pour-in device for swinging movement about a second horizontal axis, said assemblies being connected to said pivoting arms to drive the same, and, (e) linkage means pivotally attached to both said pour-in device and said lifting device, providing for turning movement of the said lifting device relative to said pivoting arms inwardly with respect to the said pour-in device when the said pivoting arms are swung upwardly, and providing for an opposite turning movement of said lifting device outwardly with respect to the said pour-in device when said pivoting arms are swung downwardly, (f) the said lifting device containing angular levers having corner portions, and which at said corner portions are swingably mounted on other ends of said pivoting arms, said levers having first lever arms adapted for gripping the said containers and second lever arms connected to said linkage means to provide for turning movement of the said lifting device relative to the said lifting arms, (g) the said pivoting arms having lugs provided at their said one ends, extending away from the said second horizontal pivotal axis, (h) the said elongate cylinder-piston assemblies extending substantially parallel to and behind the said pivoting arms and being pivotally attached to the said lugs of the said pivoting arms.

18. A lifting-tilting apparatus as defined in claim 17, and further including:

(a) mounting plate means secured to said pour-in device, comprising a mounting plate for each of said pivoting arms to mount the latter, (b) said mounting plates being adapted for pivotal connection to the said pivoting arms, to the said elongated cylinder-piston assemblies and to the said linkage means, thereby to provide for the said relative turning movement of the said lifting device with respect to the said pour-in device.

* * * * *